United States Patent [19]

Dworak et al.

[11] 4,455,130

[45] Jun. 19, 1984

[54] GEAR MACHINE WITH OPPOSITELY ALIGNED SEALING ELEMENTS

[75] Inventors: Wilhelm Dworak, Stuttgart; Siegfried Mayer; Karl-Heinz Müller, both of Vaihingen; Wolfgang Talmon, Oetisheim; Günter Wolff, Schwieberdingen, all of Fed. Rep. of Germany

[73] Assignee: Robert Bosch GmbH, Stuttgart, Fed. Rep. of Germany

[21] Appl. No.: 355,535

[22] Filed: Mar. 8, 1982

[30] Foreign Application Priority Data

Apr. 7, 1981 [DE] Fed. Rep. of Germany ..... 3113939

[51] Int. Cl.[3] ..... F03C 2/08

[52] U.S. Cl. ..... 418/132

[58] Field of Search ..... 418/131, 132, 135, 133, 418/134; 384/151

[56] References Cited

U.S. PATENT DOCUMENTS

| | | | |
|---|---|---|---|
| 2,996,997 | 8/1961 | Oliver | 418/132 |
| 3,891,360 | 6/1975 | Dworak et al. | 418/132 |
| 4,029,446 | 6/1977 | Mayer et al. | 418/132 |
| 4,281,974 | 8/1981 | Teruyama | 418/132 |
| 4,311,444 | 1/1982 | Shumate | 418/131 |

FOREIGN PATENT DOCUMENTS

| | | | |
|---|---|---|---|
| 1703180 | 12/1971 | Fed. Rep. of Germany | 418/131 |

*Primary Examiner*—Leonard E. Smith
*Assistant Examiner*—T. Olds
*Attorney, Agent, or Firm*—Michael J. Striker

[57] ABSTRACT

A hydraulic gear machine which is particularly suited for use as a reversible hydraulic gear motor includes a pair of gear elements having externally meshing outer peripheral gear portions and stub shafts which are supported in an internal chamber of a housing on respective sleeve-shaped bearings. Two such bearings are arranged at each axial side of the gear elements, one for the stub shaft of each of the gear elements which extends to this axial side. The housing includes a circumferential wall and two end walls. Sealing elements having the configuration of the numeral three are arranged at the interfaces between the bearings and the end walls. The sealing elements are oppositely oriented with respect to a common plane including the axes of rotation of the gear elements at the respective axial sides. Depending on the direction of flow of pressurized hydraulic medium through the machine, a dominating pressure zone builds up at one or the other of the interfaces, the effect of the pressure of the pressurized medium on this pressure zone being to press the bearings in a sealing manner against the gear elements to eliminate gaps therebetween through which the pressurized hydraulic medium could otherwise escape without transferring its energy to the gear elements as useful mechanical energy.

9 Claims, 5 Drawing Figures

V
18
16
31
11

III
A
17
19
III
II
35(36)
10
II
14
15
25
B
22
23
13
IV
IV
12
24
28
26
27
V 35
39
40
36

GEAR MACHINE WITH OPPOSITELY ALIGNED SEALING ELEMENTS

BACKGROUND OF THE INVENTION

The present invention relates to hydraulic gear machines in general, that is, to machines utilizing meshing gears for effecting conversion between the potential energy of a pressurized hydraulic medium and the kinetic energy of a rotating shaft, and more particularly to a hydraulic gear machine which is especially suited for use as a hydraulic gear motor.

There are already known various constructions of hydraulic gear machines of the type here under consideration, in which two gear elements are in external meshing engagement with one another and have respective stub shafts which are supported in the housing of the machine on respective bearings which are mounted in the housing for limited axial displacement relative thereto. It is also known to provide axially effective pressure zones acted upon by the pressurized hydraulic medium from the high pressure side of the machine for pressing the bearings against the gear elements at the end surfaces of the bearings which face away from the gear elements, these pressure zones being delimited by respective seals and extending only over a portion of the total available area of the respective bearings.

In one conventional construction of the gear machine of this type, there is provided in the housing, in addition to the bearing elements, a pressure plate on which pressure zones are delimited by a seal arranged in an associated end wall or lid portion of the housing of the machine. The pressure of the pressurized hydraulic medium which acts on the respective pressure zone of the pressure plate is transmitted by the latter to the bearings to press the same into a sealing contact with the axial end faces of the gear elements. An arrangement of this particular type is particularly suited for use as a reversible gear motor, since the pressure of the hydraulic medium is always applied to the pressure zone situated at the proper side. However, this arrangement is rather expensive, since it requires the provision of components which are especially designed and manufactured for use in a gear motor.

SUMMARY OF THE INVENTION

Accordingly, it is a general object of the present invention to avoid the disadvantages of the prior art.

More particularly, it is an object of the invention to provide a hydraulic gear machine, particularly a hydraulic gear motor, of the type here under consideration, which does not possess the disadvantages of the conventional hydraulic gear machines of this type.

Still another object of the present invention is to so design the hydraulic gear machine of this type as not to require the provision of any specially designed parts which find their utility only in hydraulic gear motors but not in hydraulic gear pumps.

It is yet another object of the present invention to so construct the hydraulic gear machine as to be usable both as a pump and a reversible motor, without significantly increasing the manufacturing cost of the machine above that of the hydraulic gear pump of the conventional construction, thereby realizing the savings attendant to the large-series manufacture.

A concomitant object of the present invention is to develop a hydraulic gear machine of the above type which is simple in construction, inexpensive to manufacture, easy to use, and reliable in operation nevertheless.

In pursuance of these objects and others which will become apparent hereafter, one feature of the present invention resides in a hydraulic gear machine, which is especially suited for use as a hydraulic gear motor, particularly a reversible one, this gear machine including a housing defining a chamber;. a pair of gear elements each having an axis and including a peripheral gear portion and two shaft portions extending to opposite axial sides of the gear portion; means for mounting the gear elements in the chamber such that the axes are arranged in a common plane and the gear portions mesh with one another during the rotation of the gear elements, the mounting means including respective bearings for the respective shaft portions, the bearings having respective axial end surfaces bounding axially spaced interfaces with the housing, at least the bearings being mounted for limited axial displacement in the chamber; and means for urging the bearings into contact with the gear elements during the operation of the machine, the urging means including sealing means bounding a pressure compartment in each of the interfaces and delimiting a pressure zone on each of the end surfaces, the pressure zones being situated substantially at the same side of the common plane and having mutually opposite configurations on the axially spaced interfaces, the urging means further including means for admitting pressurized hydraulic medium into at least one of the pressure compartments for the pressurized hydraulic medium to act on the respective pressure zone and to axially displace the respective bearing toward the associated gear element.

A particular advantage of this construction is to be seen in the fact that, by appropriately selecting the course along which the sealing means extends at each of the interfaces, it is possible to provide a hydraulic gear machine which is particularly suited for use as a hydraulic gear motor but can also be used as a hydraulic gear pump without increasing the cost of the latter, since a seal will have to be provided in the pump of this type as well, in order to separate the high-pressure side from the low-pressure side thereof.

According to a currently preferred aspect of the present invention, the sealing means includes a sealing member at each of the interfaces, this sealing member extending in the respective interface along a course substantially reminiscent of that of the numeral three. In this context, it is especially advantageous when the bearings have respective recesses at the respective end faces thereof, these recesses extending along the respective courses and partially accommodating the respective sealing members. To obtain the desired opposite configuration of the pressure zones of the respective end surfaces, it is provided, in accordance with a further aspect of the present invention, for the course of the sealing member situated at one of the interfaces to be reversed relative to that of the sealing member situated at the other, axially spaced, interface.

Construction and assembly advantages are obtained when, in accordance with a further concept of the present inventions, the bearings include two separate bearing sleeves at each of the axial sides of the respective gear portions of the gear elements, each of such separate bearing sleeves supporting the respective shaft portion of a different one of the gear elements. It is further advantageous when the bearing sleeves disposed at the respective axial side of the gear portions are in abutment with one another.

A particularly advantageous construction of the hydraulic gear machine is obtained when the gear portions of the gear elements delimit respective pressure spaces in the chamber, one of these pressure spaces containing pressurized hydraulic medium during the operation of the machine, and when the admitting means includes means for defining at least one passage connecting the one pressure space with the one pressure compartment. However, it is also advantageous when, in accordance with a further facet of the present invention, the defining means further defines an additional passage connecting the one pressure space with the other pressure compartment which is situated at the other, axially spaced, interface from that provided with the one pressure compartment. Advantageously, the pressure zones on the end surfaces of the bearings have different effective areas.

The machine of the present invention is especially suited for use in a reversing mode of operation, when the sealing means is caused to further bound an additional pressure compartment in each of the interfaces and delimit an additional pressure zone on each of the end surfaces, such additional pressure compartments and zones respectively substantially complementing the initially mentioned pressure compartments and zones. Then, the admitting means is advantageously operative for admitting the pressurized hydraulic medium to one of the pressure and additional compartments of the respective interface to the exclusion of the other of the additional pressure and pressure compartments of the same interface in dependence on the sense of rotation of the gear elements. Then, it is further advantageous when the aforementioned one pressure space containing the pressurized hydraulic medium is situated, in dependence on the sense of rotation of the gear elements, at the same side of the common plane as the one of the pressure and additional pressure compartments.

The novel features which are considered as characteristic of the invention are set forth in particular in the appended claims. The improved hydraulic gear machine itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
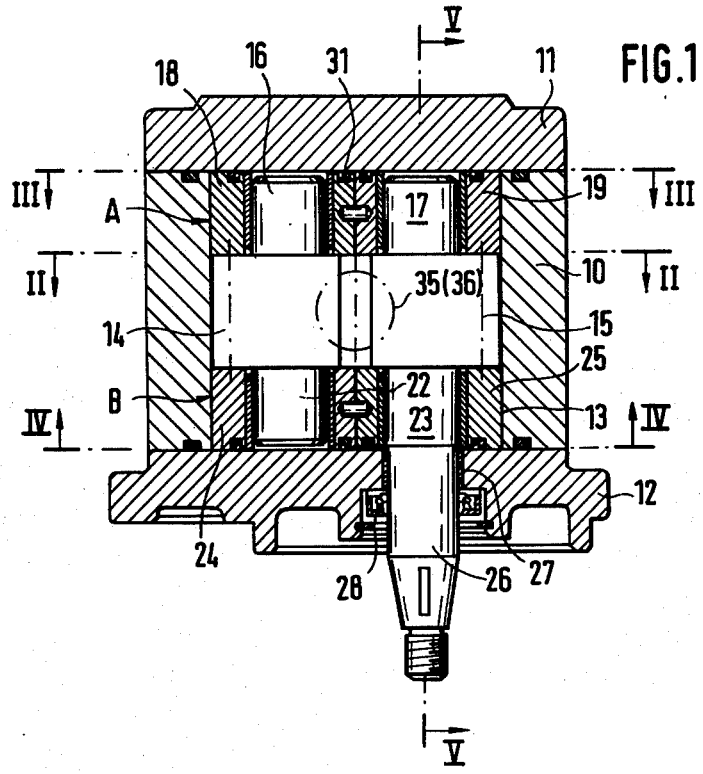
FIG. 1 is a longitudinal axial cross-sectional view of a hydraulic gear machine according to the present invention.
Figure 2:
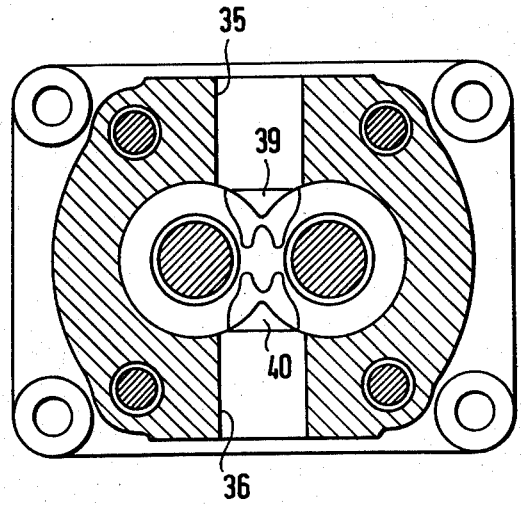
FIG. 2 is a cross-sectional view taken along the line II—II of FIG. 1.

Referring now to the drawing in detail, and first to FIG. 1 thereof, it may be seen that the hydraulic gear machine of the present invention includes, as one of its components, a housing 10, 11, 12. The housing 10, 11, 12 includes a central portion or circumferential wall 10 which is closed, at each of its axial ends, by a respective axial wall or lid 11 or 12. The circumferential wall peripherally bounds a through passage or chamber 13. The cross-sectional configuration of the chamber 13 is reminiscent of that of the numeral 8, as may be ascertained, for instance, from FIG. 2.

As may also be seen in FIG. 1, the chamber 13 accommodates a pair of gears 14 and 15 which have respective peripheral gear portions that mesh with one another. Both of the gears or gear elements 14 and 15 further include two stub shaft portions 16 or 17 which are supported in the housing 10, 11, and 12 by respective bearings 18 and 19, and 22 or 23 which are supported in the housing 10, 11 and 12 by respective bearings 24 and 25. The bearings 18, 19, 24, and 25 have similar or identical configurations and are preferably sleeve-shaped. The bearings 18 and 19 are arranged at the lid 11 and consitute a bearing assembly A, while the bearings 24 and 25 are situated at the lid 12 and constitute a bearing assembly B. The stub shaft 23 has an extension 26 which passes through a bore 27 in the lid 12 to the exterior of the housing 10, 11, 12 to constitute a drive shaft of the hydraulic gear machine. A sealing arrangement 28 seals the extension 26 of the stub shaft 23 in the bore 27 of the lid 12.

Figure 5:
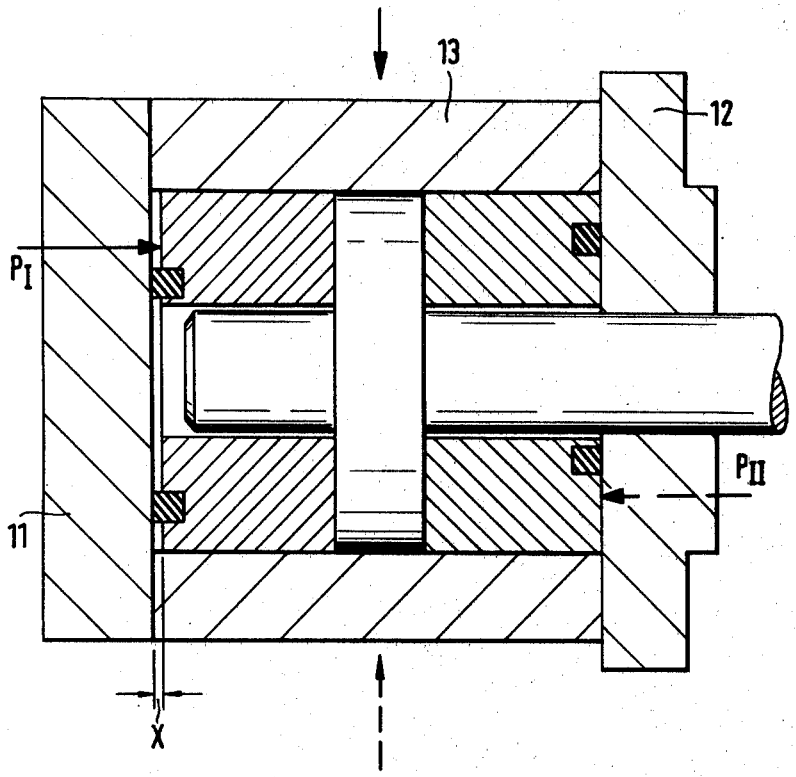
FIG. 5 is a slightly simplified axial sectional view taken along the line V—V of FIG. 1.

As indicated in FIG. 5, the bearings 18, 19, 24 and 25 are received in the chamber 13 of the housing 10, 11, 12 with an axial play X, that is, with freedom of limited axial displacement in the chamber 13. While the bearings 18, 19, 24 and 25 have been illustrated as being separate elements, it is also possible to make the bearings 18 and 19 of the bearing assembly A, on the one hand, and the bearings 24 and 25 of the bearing assembly B, as intergral elements having a configuration resembling that of a pair of eyeglasses.

A continuous groove 30 is formed at the end surfaces of the bearings 18 and 19 which face toward the lid 11, the groove 30 having a configuration resembling that of the numeral three. A seal or sealing member 31 is partially received in this groove 30, the seal 31 extending along the same course as the groove 30. The numeral three is open in the leftward direction, as may be seen in FIG. 3. Similarly, a continuous groove 32 is formed at the end surfaces outside the bearings 24 and 25 which face toward the lid 12. The groove 32 also has a configuration reminiscent of the numeral three. A seal or sealing member 33 is fittingly partially received in the groove 32. As may be seen in FIG. 4, the numeral three is open in the rightward direction. Thus, it may be seen that the seals 31 and 33 at the bearing arrangements A and B have opposite configurations or orientations with respect to one another.

Two bores or ports 35, 36 penetrate through the circumferential wall 10 from the exterior of the housing 10, 11, 12 into the chamber 13. The ports 35 and 36 are arranged oppositely to and in registry with one another in that they are centered on the same axis extending transversely to the elongation of the chamber 13. The ports 35 and 36 are arranged at the region of the gear elements 14, 15. Substantially triangular pressure spaces 37, 38 or 39, 40 are formed between the respective bearings 18, 19 or 24, 25 and the surface bounding the chamber 13, these pressure spaces or passages 37, 38, 39 and 40 extending over the entire axial lengths of the respective bearings 18, 19, 24, and 25. In this manner, there is established communication between the ports 35, 36 and the end faces of the bearing elements 18, 19, 24 and 25 which face away from the gear elements 14 and 15.

Having so described the construction of the hydraulic gear machine of the present invention, the operation thereof will now be explained.

Figure 3:
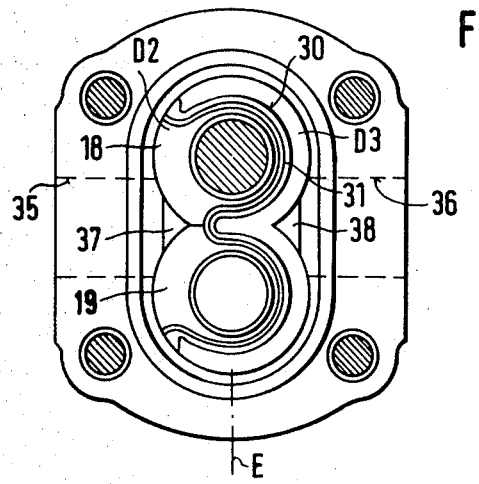
FIG. 3 is a cross-sectional view taken along the line III—III of FIG. 1.
Figure 4:
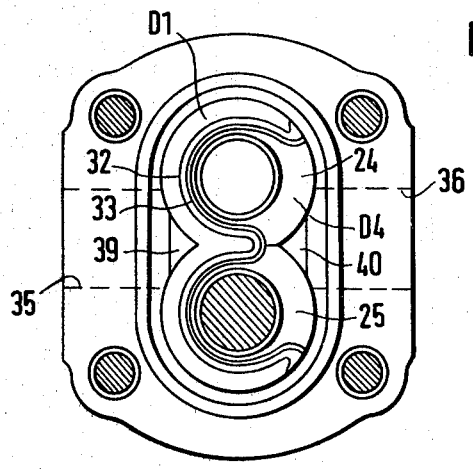
FIG. 4 is a cross-sectional view taken along the line IV—IV of FIG. 1.

Let us assume that the hydraulic gear machine depicted in the drawing is to be used as a hydraulic gear motor and that pressurized hydraulic medium is admitted at a relatively high pressure to the port 35 for this purpose. As a result of the admission of the high-pressure hydraulic medium to the port 35, the gears 14 and 15 start to rotate owing to the pressure differential between the high-pressure port 35 and the low-pressure port 36, and an output torque appears on the stub shaft 23 and its extension 26. What is now important is that the bearings 18, 19 and 24, 25 be sealingly pressed against the axial end faces of the gear elements 14, 15, at least at the high-pressure side, in order to prevent the high-pressure medium flowing into the chamber 13 from forming gaps between these components and from escaping through such gaps to the low-pressure port 36 without being converted into useful mechanical energy in the form of the output torque on the extension 26. This requirement is satisfied in that a part of the high-pressure hydraulic medium is permitted to flow through the passages 37 and 39 to the rear end faces of the bearings 18, 19, 24, 25. Now, considering FIG. 4 of the drawing, it may be seen that the pressurized hydraulic medium is permitted to act on a pressure zone D1 of the rear surface of the bearings 24 and 25 which is delimited by the sealing element 33, that is, between the latter and the passage 39. Owing to the configuration of the sealing element 33, the location of the imaginary force resulting from the pressure of the pressurized hydraulic medium on the pressure zone D1 is situated much closer to the high-pressure port 35 than to the low-pressure port 36, with respect to a common plane E connecting the axes of rotation of the gear elements 14 and 15 which is indicated in FIG. 3. However, at the same time, high pressure of the hydraulic medium can momentarily build up at and become effective on a pressure zone D2 delimited by the sealing element 31, that is, between the open end of the latter and the passage 37. However, since the effective area of the pressure zone D1 is much greater than that of the pressure zone D2, the axial force P1 acting on the pressure zone D1 and indicated in FIG. 5 outweighs the force acting on the pressure zone D2 and the entire assembly of the gear elements 14 and 15 with the bearings 18, 19, 24 and 25 is axially shifted toward the lid 12. This shifting will be more pronounced on the high-pressure side situated at the high-pressure port 35, since most of the area of the pressure zone D1 is situated at this side of the common plane E. At the same time, respective pressure zones D3 and D4 which complement the pressure zones D1 and D2 and are separated therefrom by the respective sealing elements 31 and 33 are subjected only to the low pressure prevailing in the low-pressure port 36, or substantially so. Upon the conclusion of the aforementioned axial shifting, the pressure acting on the pressure zone D2 gradually diminishes, but the magnitude of the gaps between the end surfaces of the gear elements 14 and 15 and the end faces of the bearings 18, 19, 24 and 25 which face the same is maintained substantially at zero. In this manner, it is possible to assure an unproblematical start of the operation of the gear motor. The pressurized hydraulic medium, after having given up its energy to the gear elements 14 and 15, flows out of the chamber 13 through the low-pressure port 36.

On the other hand, when it is desired to operate the hydraulic gear machine shown in the drawings as a hydraulic gear motor but with a reverse sense of rotation of the output shaft 23, 26, it is merely necessary to admit the high-pressure hydraulic medium to the port 36 rather than to the port 35, and to connect the other port 35 to a low-pressure sink. Under these circumstances, as may be seen particularly in FIG. 3, a large pressure zone D3 becomes effective. This pressure zone D3 is situated between the sealing element 31 and the passage 38. Simultaneously therewith, a smaller pressure zone D4 becomes effective at the open part of the sealing element 33, as may be seen in FIG. 4, that is, between the passage 40 and the open part of the sealing element 33. In this situation, a force P2 effective on the larger pressure zone D3 outweighs the opposite force acting on the pressure zone D4, but the force P2 now acts in the opposite direction than the force P1 did when the machine was operated in the original sense of rotation. In all other respects, however, the end effect is the same as before.

In this manner, it is possible to accomplish a simple construction of a hydraulic gear machine which is usable as a reversible hydraulic gear motor, while using the same bearings 18, 19, 24 and 25 and the same sealing elements 31 and 33 at the bearing arrangements A and B, by merely resorting to the expedient of oppositely orienting the sealing elements 31 and 33 at the bearing arrangements A, on the one hand, and B, on the other hand.

It will be understood that each of the elements described above, or two or more together, may also find a useful application in other types of arrangements differing from the type described above.

While the invention has been illustrated and described as embodied in a hydraulic gear machine which is particularly suited for use as a hydraulic gear motor with a reversible operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A hydraulic gear machine, especially for use as a hydraulic gear motor, comprising a housing defining a chamber; a pair of gear elements each having an axis and including a peripheral gear portion and two shaft portions extending to opposite axial sides of said gear portion; means for so mounting said gear elements in said chamber for rotation that said axes are arranged in a common plane and said gear portions mesh with one another, said mounting means including respective bearings for said shaft portions having respective end surfaces bounding axially spaced interfaces with said housing, at least said bearings being mounted for limited axial displacement in said chamber; and means for urging said bearings into contact with said gear elements during the operation of the machine, including sealing means bounding a pressure compartment in each of said interfaces and delimiting a pressure zone on each of said end surfaces, said sealing means including at each of said interfaces a sealing member extending in the respective interface along a course substantially reminiscent of that of the numeral three, said course of said sealing member situated at one of said interfaces being reversed relative to that of said sealing member situated at the other axially spaced interface; and means for admitting pressurized hydraulic medium into at least one of said pressure compartments to act on the respective pressure zone and axially displace the respective bearing toward the associated gear element.

2. The machine as defined in claim 1, wherein said bearings have respective recesses at said end faces thereof which extend along said course and partially receive the respective sealing members.

3. The machine as defined in claim 1, wherein said bearings include two separate bearing sleeves at each of said axial sides, each supporting the respective shaft portion of a different one of said gear elements.

4. The machine as defined in claim 3, wherein said bearing sleeves disposed at the respective axial side of said gear portions are in abutment with one another.

5. The machine as defined in claim 1, wherein said gear portions of said gear elements delimit respective pressure spaces in said chamber, one of said pressure spaces containing pressurized hydraulic medium during the operation of the machine; and wherein said admitting means includes means for defining at least one passage connecting said one pressure space with said one pressure compartment.

6. The machine as defined in claim 5, wherein said defining means further defines an additional passage connecting said one pressure compartment with the other pressure compartment.

7. The machine as defined in claim 1, wherein said pressure zones on said end faces have different effective areas.

8. The machine as defined in claim 1 for use in a reversing mode of operation, wherein said sealing means further bounds an additional pressure compartment in each of said interfaces and delimits an additional pressure zone on each of said end surfaces which respectively substantially complement the respective pressure compartment and pressure zone; and wherein said admitting means is operative for admitting the pressurized hydraulic medium to one of said pressure and additional pressure compartments of the respective interface to the exclusion of the other of said additional pressure and pressure compartments of the same interface in dependence on the sense of rotation of said gear elements.

9. The machine as defined in claim 8, wherein said gear portions of said gear elements delimit respective pressure spaces in said chamber, one of said pressure spaces containing pressurized hydraulic medium during the operation of the machine depending on the sense of rotation of said gear elements.

* * * * *